US009149140B1

(12) United States Patent
Weakley

(10) Patent No.: US 9,149,140 B1
(45) Date of Patent: Oct. 6, 2015

(54) SKI BOOT REMOVAL TOOL AND METHOD OF USE

(71) Applicant: John Weakley, Evergreen, CO (US)

(72) Inventor: John Weakley, Evergreen, CO (US)

( * ) Notice: Subject to any disclaimer, the term of this patent is extended or adjusted under 35 U.S.C. 154(b) by 0 days.

(21) Appl. No.: 14/511,820

(22) Filed: Oct. 10, 2014

Related U.S. Application Data

(60) Provisional application No. 62/034,895, filed on Aug. 8, 2014, provisional application No. 61/889,493, filed on Oct. 10, 2013.

(51) Int. Cl.
*A47G 25/80* (2006.01)

(52) U.S. Cl.
CPC ..... *A47G 25/80* (2013.01)

(58) Field of Classification Search
CPC ..... A47G 25/80; A47G 25/82
USPC ..... 223/113, 114
See application file for complete search history.

(56) References Cited

U.S. PATENT DOCUMENTS

| | | | | | |
|---|---|---|---|---|---|
| 28,927 | A | | 6/1860 | Wheeler | |
| 196,857 | A | * | 11/1877 | Aufderheide | 223/119 |
| 594,894 | A | * | 12/1897 | Nylander | 223/118 |
| 954,061 | A | * | 4/1910 | Taxis | 223/113 |
| 1,423,422 | A | * | 7/1922 | Harms | 223/119 |
| 3,604,604 | A | | 9/1971 | Ahn | |
| D257,188 | S | | 10/1980 | Blicha | |
| 4,394,946 | A | * | 7/1983 | McCormick | 223/115 |
| 4,709,839 | A | * | 12/1987 | Tucker | 223/119 |
| 4,756,453 | A | * | 7/1988 | Pettit et al. | 223/111 |
| D317,077 | S | | 5/1991 | Schulz | |
| 5,385,279 | A | * | 1/1995 | Dawson | 223/114 |
| D372,113 | S | | 7/1996 | Palmer et al. | |
| 5,566,868 | A | | 10/1996 | Mariscal et al. | |
| 5,924,610 | A | * | 7/1999 | Willemin | 223/112 |
| D659,948 | S | | 5/2012 | Weakley | |
| 2010/0264174 | A1 | | 10/2010 | Anderson, Jr. | |

FOREIGN PATENT DOCUMENTS

| | | | | | |
|---|---|---|---|---|---|
| JP | 2001286383 | A | * | 10/2001 | A47G 25/82 |
| WO | WO 2010139467 | A1 | * | 12/2010 | A47G 25/80 |

OTHER PUBLICATIONS

Machine Translation of WO 2010/139467 (EPO).*

* cited by examiner

*Primary Examiner* — Nathan Durham
(74) *Attorney, Agent, or Firm* — Allen D. Hertz, P.A.; Allen D. Hertz

(57) ABSTRACT

A method of removing a foot from a boot having an upper binding, the method employing a boot removal tool. The boot removal tool includes a heel gripping element carried by an operational end of an elongated shaft and a handle at an opposite, gripping end thereof. A calf boot shaft hook includes a boot shaft hook cantilevered elongated element, wherein the shaft hook is carried by a central region of the elongated shaft. In use, the cantilevered elongated element is inserted into a boot shaft between an interior rear surface and a wearer's calf. The heel gripping element is positioned contacting a heel section of the boot. The user draws the grip rearward, pivoting the tool against the heel, opening a boot shaft pivotal calf segment of the boot shaft. The tool introduces a downward retention force. The combination aids in removal of the wearer's foot from the boot.

20 Claims, 7 Drawing Sheets

SKI BOOT REMOVAL TOOL AND METHOD OF USE

CROSS-REFERENCE TO RELATED APPLICATIONS

This Non-Provisional Utility Patent Application claims the benefit of U.S. Provisional Patent Application Ser. No. 62/034,895, filed on Aug. 8, 2014 and also claims the benefit of U.S. Provisional Patent Application Ser. No. 61/889,493, filed on Oct. 10, 2013, both of which are incorporated herein by reference.

FIELD OF THE INVENTION

The present invention relates to a boot removal tool and a method of use thereof, and more particularly, a boot removal tool comprising a heel support feature and a gripping hook for insertion behind a calf portion of a boot shaft, wherein the boot removal tool provides a leverage for rotating the calf portion of the boot shaft outward as well as providing a downward force thereto, thus aiding the wearer in extracting their foot from the boot while in an upright position and in a safe and easy manner.

BACKGROUND OF THE INVENTION

Boots are a specific type of footwear that covers the foot and the ankle but extends up the leg, sometimes as far as the knees. These are normally made of leather, plastic, rubber as well as a variety of materials. Boots are worn for both their functionality, to protect the user from the weather and to support the ankle and for reason of esthetics and fashion. Specialty boots are made for sporting events such as riding, skiing, snowboarding and other conditions. Boots are normally very difficult to remove.

Ski Boots are tightly bound to an individual's foot. The design of the ski boot makes it very difficult to remove the wearer's foot from the boot.

Accordingly, there remains a need in the art for a device and an associated method of use for aiding in removal of a wearer's foot from the boot.

SUMMARY OF THE INVENTION

The present invention overcomes the deficiencies of the known art and the problems that remain unsolved by providing a method and respective apparatus for aiding in a removal of a boot, from a wearer's foot.

In accordance with one embodiment of the present invention, the invention includes a method of extracting a foot from a boot, the method comprising steps of:

obtaining a boot removal tool, the boot removal tool comprising:

an elongated shaft extending between a heel engagement end and a handle, a heel gripping element extending generally perpendicular from the heel engagement end of the elongated shaft, and a calf boot shaft hook comprising an attachment end and a cantilevered elongated element terminating at a free hook end, wherein the calf boot shaft hook is carried by the elongated shaft at a location between the heel gripping element and the handle;

sliding a free hook end of said cantilevered elongated element into a calf segment of a boot shaft of said boot, wherein said calf region of a boot shaft is pivotally attached to a boot upper section of said boot;

abutting the heel gripping element against a rear portion of the boot; and applying at least one of:

a rearward force to the handle, wherein the rearward force pivots the boot removal tool about a fulcrum point defined by the point of contact of the heel gripping element against the rear portion of the boot and a resulting motion of the boot removal tool causes the calf region of the boot shaft of the boot to pivot outward, and a downward force to the handle, wherein the downward force applied through the boot removal tool aids in extracting the wearer's foot from the boot by conveying the downward force from the calf boot shaft hook onto an upper edge of the calf region of the boot shaft.

Throughout the application, the terminology and reference to the heel engagement end of the device and the respective contact points to the boot can refer to any location including a heel end of the boot through a lower portion of a calf end of the boot shaft.

In a second aspect, the wearer would remove or extract their foot from the ski boot.

In another aspect, a shape of a lower region of a transition section formed between the cantilevered elongated element and the elongated shaft can be any suitable geometry, including an inverted "U" shape, an inverted "V" shape, an upper portion of an elliptical shape, an upper portion of a hexagonal shape, an upper portion of an octagonal shape, a square or rectangular shape, and the like.

In another aspect, the cantilevered elongated element extends generally parallel to the elongated shaft. It is noted that the term generally parallel can be defined as being within a 45 degree angle from the elongated shaft.

In another aspect, the cantilevered elongated element extends substantially parallel to the elongated shaft. It is noted that the term substantially parallel can be defined as being within a 20 degree angle from the elongated shaft.

In yet another aspect, the heel gripping element is formed having a pair of radially extending arms.

In yet another aspect, the heel gripping element is formed having a pair of radially extending arms forming a "V" shape.

In another aspect, the heel gripping element is alternatively formed having a pair of radially extending arms forming any of the following shapes, including: a "U" shape, a "V" shape, an elliptical shape, a hexagonal shape, an octagonal shape, a square or rectangular shape, and the like.

In yet another aspect, the heel gripping element is formed having a pair of radially extending arms forming a "V" shape, wherein the radially extending arms define an angle therebetween of approximately 45 degrees.

In yet another aspect, the heel gripping element is formed having a pair of radially extending arms forming a "V" shape, wherein the radially extending arms define an angle therebetween of no more than 45 degrees.

In yet another aspect, the heel gripping element is formed having a pair of radially extending arms forming a "V" shape, wherein the radially extending arms define an angle therebetween of approximately 30 degrees.

In yet another aspect, the heel gripping element is formed having a pair of radially extending arms forming a "V" shape, wherein the radially extending arms define an angle therebetween of no more than 30 degrees.

In yet another aspect, the heel gripping element is formed having a pair of radially extending arms forming a "V" shape, wherein the radially extending arms define an angle therebetween of approximately 60 degrees.

In yet another aspect, the heel gripping element is formed having a pair of radially extending arms forming a "V" shape, wherein the radially extending arms define an angle therebetween of no more than 60 degrees.

In yet another aspect, the angle between arms of the heel gripping element can be applied to any of the alternative shapes described above.

In yet another aspect, the heel gripping element further comprises a gripping feature to engaging with the heel section of the boot.

In yet another aspect, the gripping feature can be a friction enhancing material, such as a rubber block, a section of silicone, a mechanical feature designed to engage with a mating mechanical feature of the boot, and the like.

In yet another aspect, the handle can be fabricated of a pliant material, such as plastic, rubber, nylon, silicone, and the like.

In yet another aspect, the boot removal tool can be fabricated of a cast material, a molded material, and the like. The boot removal tool can be fabricated of metallic material, a composite material, a plastic and the like.

In yet another aspect, the boot removal tool can be fabricated of a unitary construction, inclusive or exclusive of the handle.

In yet another aspect, the boot removal tool can include gussets or other structural enhancing features. The gussets can be integrated between the heel gripping element and the elongated shaft, between the handle and the elongate shaft, and the like.

In yet another aspect, the attachment end of the calf boot shaft hook can be shaped having any of: a concave arch, a concave circular arch, a concave elliptical arch, a concave "V" shape, a rectangular recess, an octagonal recess, and any other suitable shape.

In yet another aspect, the boot removal tool can include an aperture or hole for attachment of a carrying element, such as a cord, and the like.

In yet another aspect, the boot removal tool can include an adjustment feature, enabling positional adjustment of the boot shaft hook. The adjustment feature enables adjustability of a distance between a boot shaft hook stop surface of the calf boot shaft hook and the heel gripping element.

In yet another aspect, the adjustment feature employs a pin and a series of pin receptacles, wherein the pin receptacles can be a series of holes, a series of bores, and the like.

In yet another aspect, the adjustment feature employs a locking toothed element and a mating toothed surface, wherein the locking toothed element engages with the mating toothed surface.

In yet another aspect, the boot can be a snow ski boot, a snowboarding boot, a roller blade boot, a roller skate boot, and the like.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
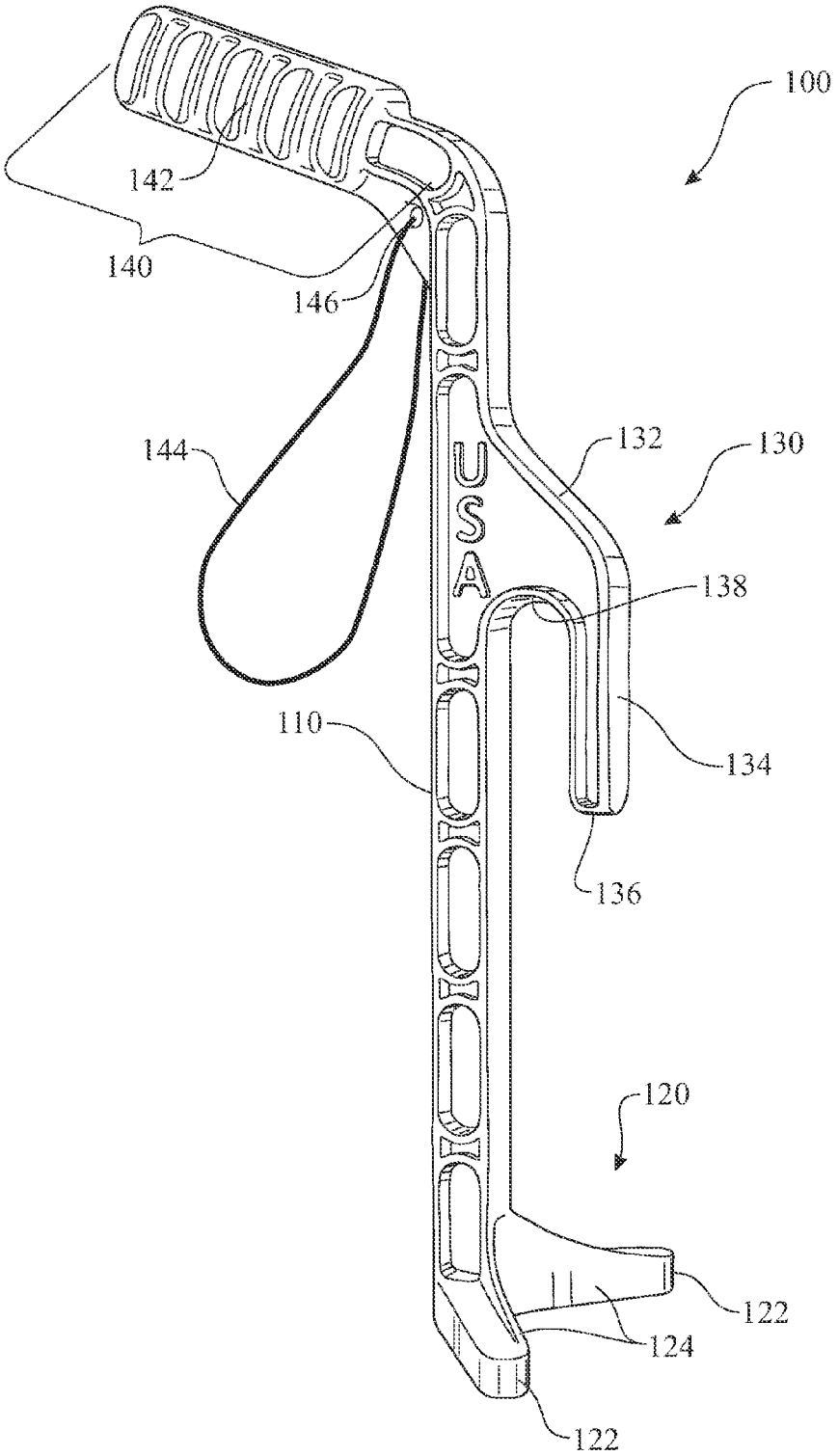
FIG. 1 presents an isometric view illustrating an exemplary boot removal tool.
Figure 2:
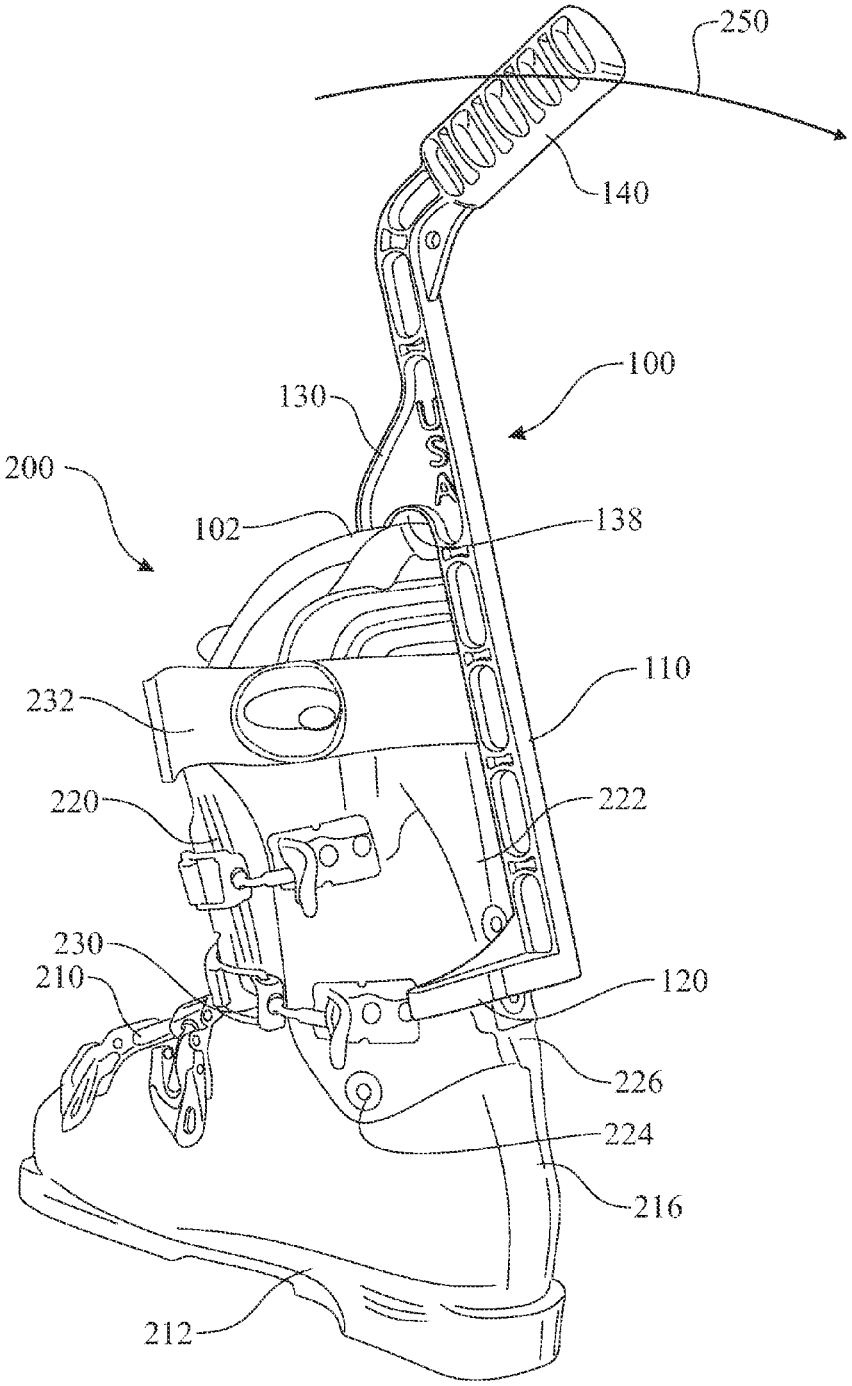
FIG. 2 presents an isometric view illustrating an initial step of an exemplary method of using the boot removal tool introduced in FIG. 1.

A boot removal tool 100, introduced in FIG. 1, is provided to assist a user in removal of their foot from a ski-boot 200 (introduced in FIG. 2). The boot removal tool 100 includes a heel gripping element 120 carried by a first or operational end of an elongated shaft 110, a handle 140 formed at a second or gripping end of the elongated shaft 110, and a calf boot shaft hook 130 carried by the elongated shaft 110 at a location between the heel gripping element 120 and the handle 140.

The boot removal tool 100 can be fabricated of any material suitable for the boot removal assistance application. This can include plastic (Polycarbonate Plastic, reinforced plastics, glass reinforced plastics), metals (aluminum, steel, brass, bronze, titanium, and the like), composites (carbon fiber, fiberglass, and the like), and the like. The boot removal tool 100 can be manufactured as an assembly comprising multiple components or as a single casting having a unitary construction. The heel gripping element 120 extends generally radially from an elongated axis of the elongated shaft 110. The heel gripping element 120 can be designed having any shape suitable to engage and grip a heel section of the ski boot 200. The heel gripping element 120 can be shaped having a pair of heel gripping arm 122 formed in a "V" shape, a "U" shape, an elliptical shape, a hexagonal shape, an octagonal shape, a square or rectangular shape, or any other suitable shape. The pair of heel gripping arm 122 can have an angular relation therebetween. The angular relation can be up to 60 degrees, up to 45 degrees, up to 30 degrees, or any other suitable angle. An internal surface of the heel gripping arm 122 (a heel gripping arm boot contacting surface 124) can be coated with a friction enhancing material (introduced as a grip enhancing element 426 in FIG. 4 for clarity), such as rubber, silicone, plastic, and the like. The handle 140 is preferably angled respective to a longitudinal axis of the elongated shaft 110. In a preferred design, the handle 140 is at a 110 degree angle from the longitudinal axis of the elongated shaft 110. This angular relation facilitates pressure in holding the boot by applying a downward force thereto.

Throughout the application, the terminology and reference to the heel engagement end 120 of the boot removal tool 100 and the respective contact points to the boot 200 (FIG. 2) can refer to any location including a heel end of the boot 200 through a lower portion of a calf end of the boot shaft 220.

The handle 140 can include a handgrip 142. The handgrip 142 can be shaped to include features enhancing a grip, such as finger grips, ribbing, bosses, and the like. The handgrip 142 can be fabricated of a pliant material for comfort, such as rubber, plastic, nylon, silicone, and the like. A grip enhancing material can be assembled to a heel gripping arm boot contacting surface 124 of each heel gripping arm 122 forming the heel gripping element 120. The grip enhancing material can be a rubber, a silicone, a plastic and the like to grip the heel section of the ski boot 200. The hand grip 142 can be overmolded onto the handle 140, slideably assembled into the handle 140, or assembled using any other suitable manner.

The boot removal tool 100 can include a carrying element 144 attached to the boot removal tool 100 by any suitable feature. In the exemplary embodiment, the carrying element 144 is a cord or leather strap inserted through a carrying element aperture 146 formed through a feature of the boot removal tool 100, such as a gusset employed to support the transition between the elongated shaft 110 and the handle 140.

In one exemplary embodiment, the elongated shaft 110 is approximately 15¾ "long and approximately ¾" wide.

Figure 3:
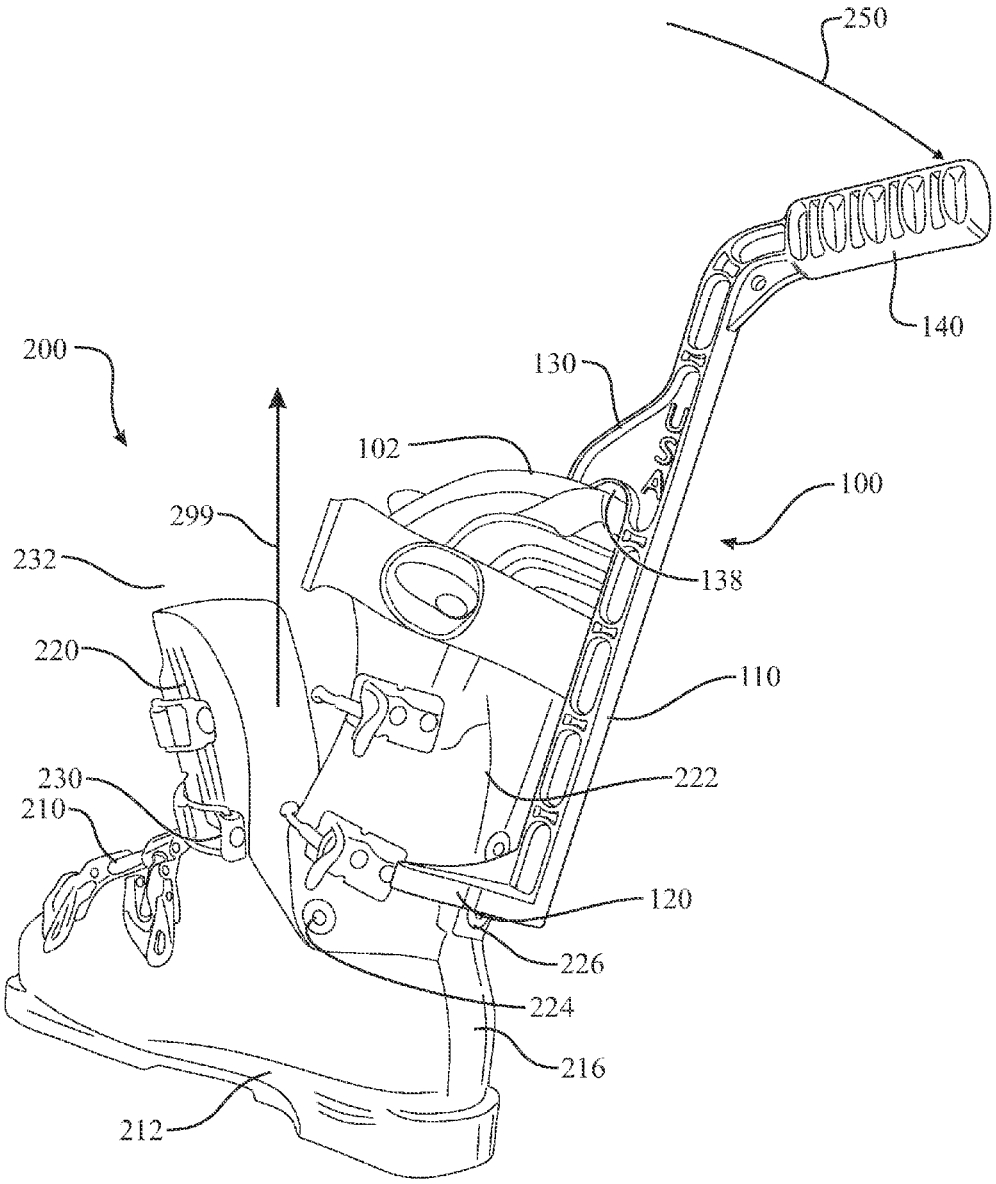
FIG. 3 presents an isometric view illustrating an opened step of the exemplary method of using the boot removal tool.
Figure 4:
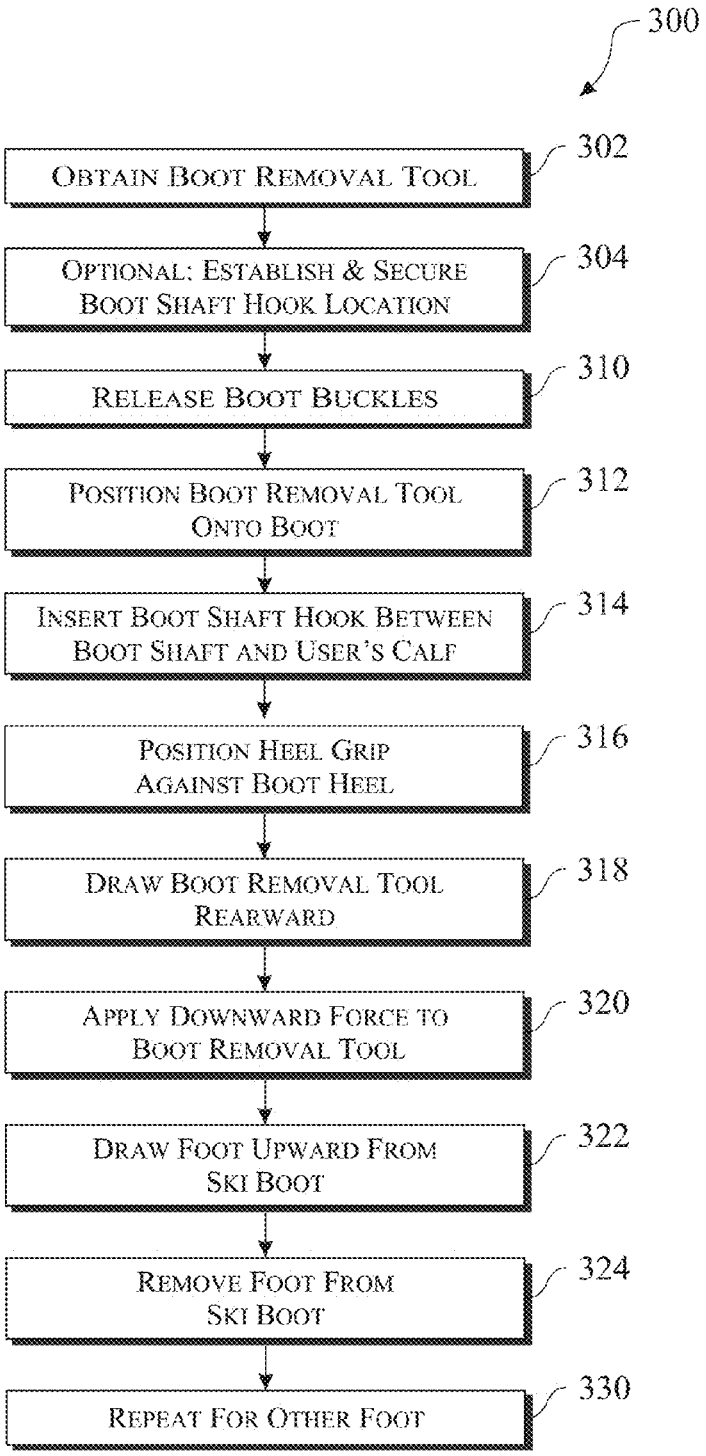
FIG. 4 presents an exemplary flow diagram describing steps of using the boot removal tool.

The method of use of the boot removal tool 100 is introduced in FIGS. 2 and 3, with an exemplary boot removal tool use flow diagram 300 being presented in FIG. 4. The ski boot 200 includes a ski boot upper 210 (generally referred to as a shell) supported by a ski boot lower 212. A boot shaft 220 (often referred to as a cuff) extends upward from the ski boot upper 210. The combination of the ski-boot upper 210, the ski-boot lower 212, and the boot shaft 220 are sized and shaped to receive and retain a foot (represented by an arrow 299) therein during use in a sporting activity. The boot shaft 220 includes a boot shaft pivotal calf segment 222 that is pivotally assembled to the ski boot 200 by a boot shaft pivotal segment hinge element 224.

Figure 5:
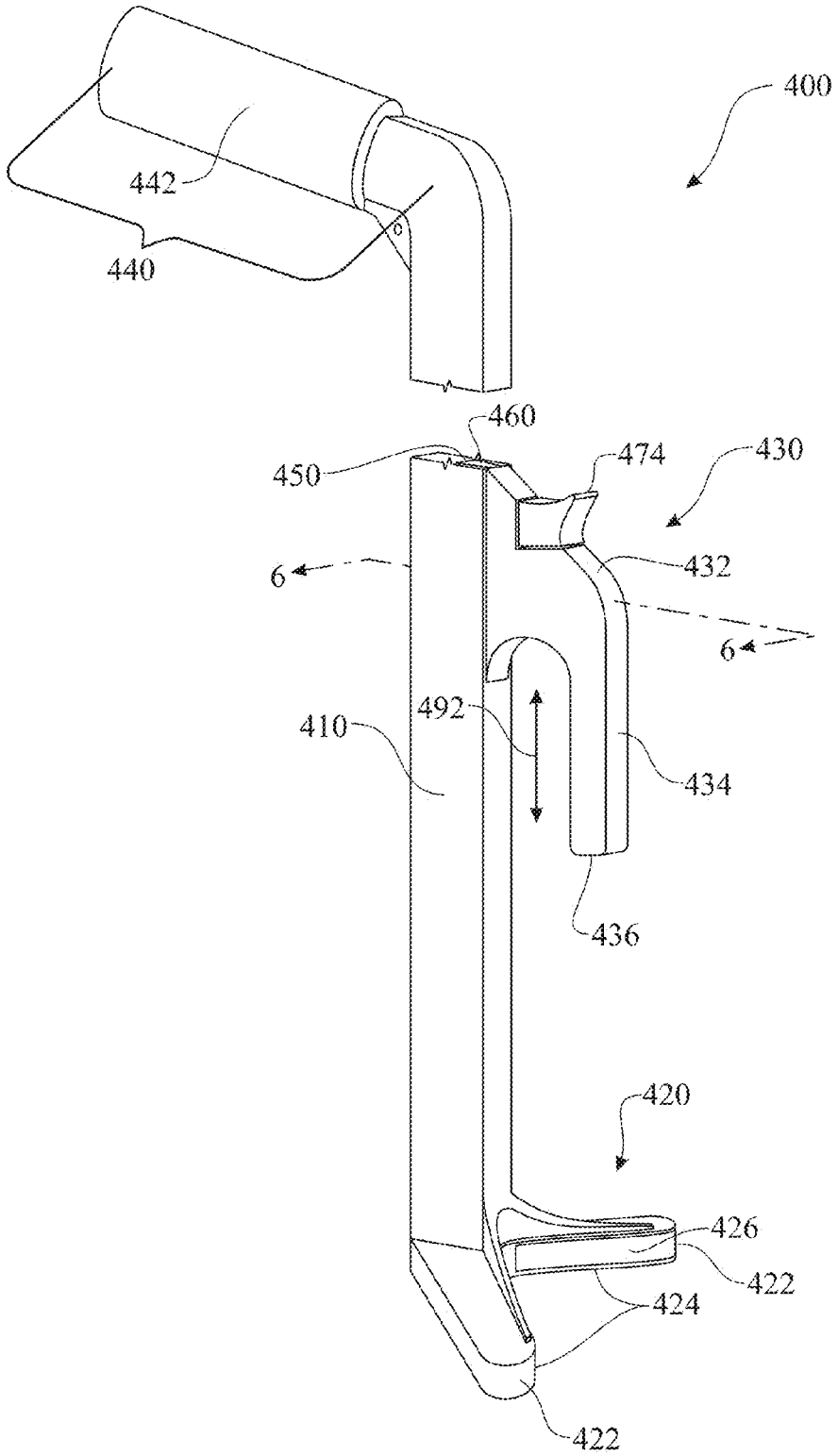
FIG. 5 presents an isometric view introducing an exemplary adjustment feature enabling adjustable positioning of a calf boot shaft hook of the boot removal tool.
Figure 6:
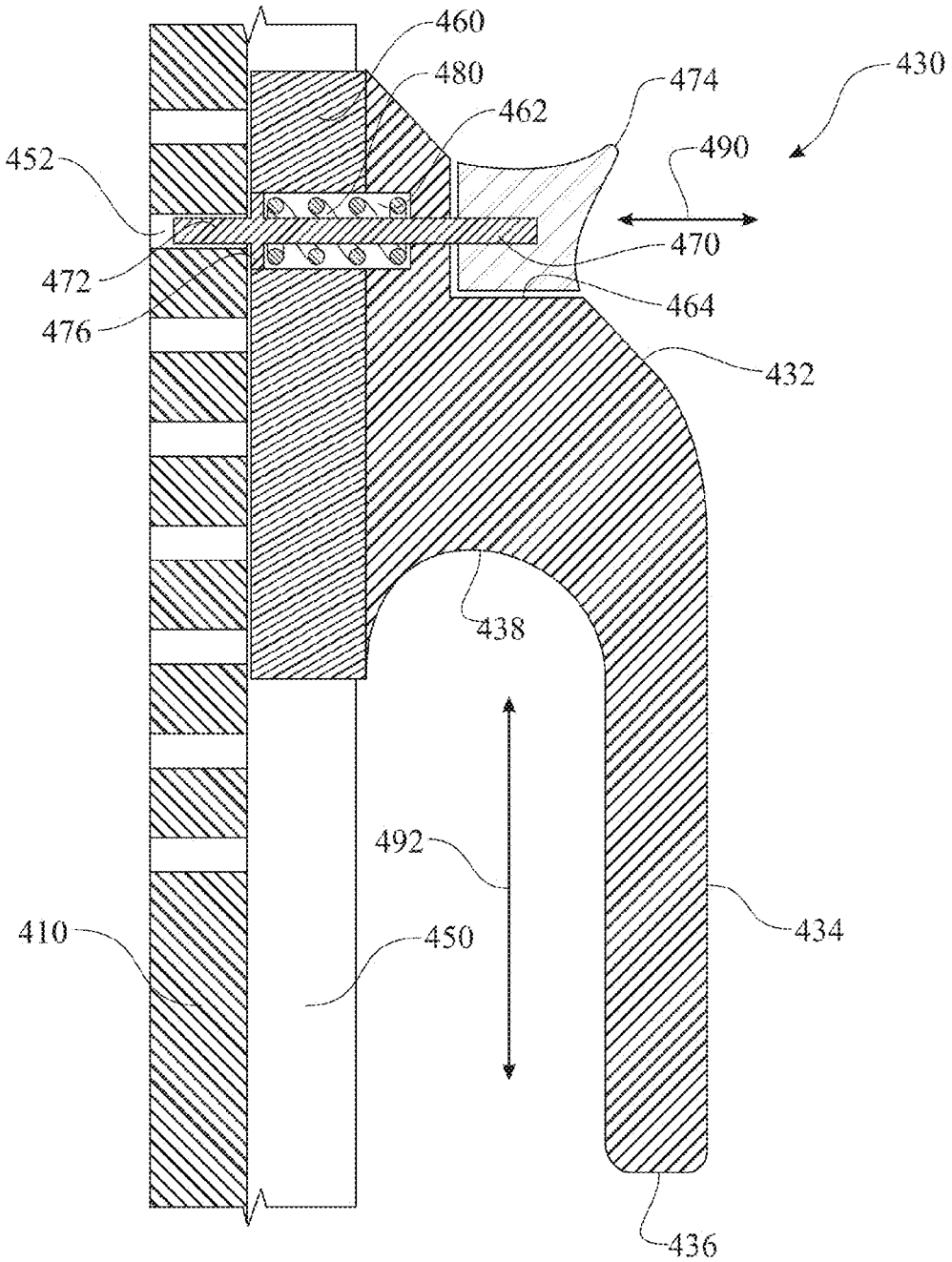
FIG. 6 presents a sectioned elevation view detailing a first exemplary adjustment feature configuration enabling adjustable positioning of a calf boot shaft hook of the boot removal tool, wherein the section is taken along section line 6-6 of FIG. 5 and the first exemplary embodiment employs a series of pins and mating holes.
Figure 7:
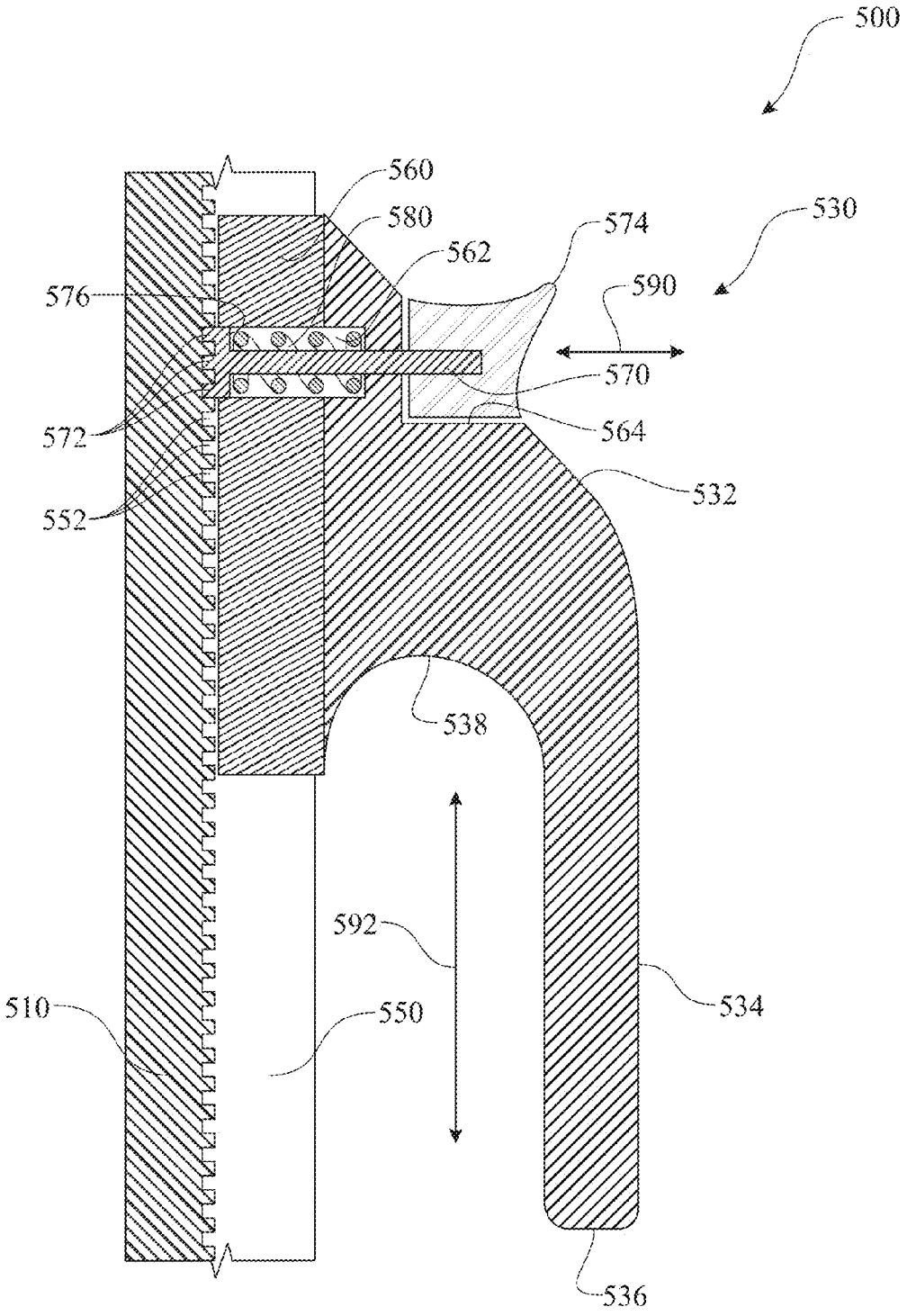
FIG. 7 presents a sectioned elevation view detailing a second exemplary adjustment feature configuration enabling adjustable positioning of a calf boot shaft hook of the boot removal tool, wherein the section is taken along section line 6-6 of FIG. 5 and the second exemplary embodiment employs a toothed locking element which engages with a series of teeth formed along the elongated shaft.

In accordance with the exemplary boot removal tool use flow diagram 300, the user would obtain the boot removal tool 100 (step 302). It is noted that the boot removal tool 100 can optionally include one or more dimensional adjustment features. Two exemplary variants are presented as a boot removal tool 400 and a boot removal tool 500 in FIGS. 5 through 7, which are described later herein. The user would optionally adjust the dimensions of the boot removal tool 100 for compatibility with the specific ski boot 200. The dimensional adjustments can include a span between the boot shaft hook stop surface 138 and the heel gripping arm 122, a angle between each heel gripping arm 122, a vertical distance between the boot shaft hook attachment end 132 and the hand grip 142, and the like. It is understood that the boot removal tool 100 can incorporate any adjustments for adaptation to a specifically sized boot. It is also understood that the boot removal tool 100 can incorporate any adjustments for adaptation to a size of a user, thus optimizing a grip location when the boot removal tool 100 is in use.

The boot wearing individual (or an assistant) would release boot buckles 230, a boot shaft retention strap 232, and/or any other element that secures the boot shaft 220 and boot shaft pivotal calf segment 222 to one another (step 310). This enables a pivotal motion of the boot shaft pivotal calf segment 222 about the boot shaft pivotal segment hinge element 224.

The user then positions the boot removal tool 100 onto the ski boot 200 (step 312). This is accomplished by directing the boot shaft hook free hook end 136 of the boot shaft hook cantilevered elongated element 134 towards the boot shaft 220 and subsequently inserting the boot shaft hook cantilevered elongated element 134 therein by sliding the boot shaft hook cantilevered elongated element 134 between a calf of the wearer and an interior surface of the boot shaft pivotal calf segment 222 (step 314). The boot shaft hook cantilevered elongated element 134 is inserted until the upper edge of the boot shaft pivotal calf segment 222 approaches and optionally contacts a lower edge (identified as a boot shaft hook stop surface 138) of the boot shaft hook attachment end 132, as illustrated in FIG. 2. The heel gripping arm boot contacting surface 124 of the heel gripping element 120 is placed in contact with the heel section of the ski boot upper 210 (step 316). The boot contacting surface 124 of the heel gripping element 120 can be placed against a boot shaft pivotal calf segment lower segment rear portion 226 (as shown), or against a boot upper rear portion 216. The user would then apply a rearward force to the handle 140, drawing the handle portion of the boot removal tool 100 rearward generating a rotational motion 250, pivoting about the contacting interface between the heel gripping arm boot contacting surface 124 and the ski-boot upper 210 (step 318). The boot removal tool pivotal operating motion 250 is translated into a rearward motion of the boot shaft hook cantilevered elongated element 134, which in turn draws the boot shaft pivotal calf segment 222 rearward away from the calf of the wearer. The heel gripping element 120 can apply a downward force to the ski boot upper 210 (step 320). The combination of the boot shaft pivotal calf segment 222 being drawn away from the calf of the wearer and the downward force from the heel gripping element 120 aids the wearer in removing or extracting their foot from the ski-boot 200. The wearer would draw their foot upward from the ski boot 200 (step 322), and subsequently removing their foot from the ski boot 200 (step 324), illustrated as an arrow representing a foot removal process 299.

The user would then repeat the process to remove their other foot from the other ski boot 200 (step 330).

The boot removal tool 100 can incorporate features enabling adjustability thereto. This can include an elongated shaft 110 having an adjustable length, a calf boot shaft hook 130 that is positionably or adjustably assembled to the elongated shaft 110 (as taught by an exemplary boot removal tool 400 (FIGS. 5 and 6) and boot removal tool 500 (FIG. 7)), a heel gripping element 120 that can be adjustably positioned along a lower end of the elongated shaft 110, and the like. The adjustable length can be accomplished using any suitable length adjusting configuration, including a sliding system, a telescoping system, a multi-position assembly interface, and the like. The pair of heel gripping arms 122 can be adjustable, enabling a change in an angle therebetween. The adjustable angle between the pair of heel gripping arms 122 can be accomplished by a pivotal motion of one or both of the heel gripping arms 122.

As previously mentioned, the boot removal tool 100 can incorporate any of a variety of adjustments enabling adaptation of the boot removal tool 100 to optimally fit a specific ski boot 200. Two exemplary embodiments are described in this disclosure. A first exemplary adjustable embodiment is referred to as a boot removal tool 400, illustrated in FIGS. 5 and 6. A second exemplary adjustable embodiment is referred to as a boot removal tool 500, illustrated in FIG. 7.

The boot removal tool 400 is an enhanced variant of the boot removal tool 100. Like features of the boot removal tool 400 and the boot removal tool 100 are numbered the same except preceded by a numeral "4". In the exemplary embodiments, the calf boot shaft hook 430 is positionably adjustable along at least a portion of a length of a elongated shaft 410. A boot shaft hook axial mating slide positioning feature 460 is slideably assembled within a elongated member hook slide positioning feature 450, wherein the calf boot shaft hook 430 slides in accordance with a slideable positioning motion 492. In the exemplary embodiment, the boot shaft hook axial mating slide positioning feature 460 is formed in a shape of a dovetail tail and the associated elongated member hook slide positioning feature 450 is formed in a shape of a dovetail slot, wherein the boot shaft hook axial mating slide positioning feature 460 slides along a length of the elongated member hook slide positioning feature 450. The sliding dovetail interface enables axial motion along a longitudinal axis of the elongated shaft 410, while restraining the calf boot shaft hook 430 from any lateral motion, twisting motion or any other undesirable motion. The boot shaft hook axial mating slide positioning feature 460 is fixed into position by a locking interface. The first exemplary locking interface employs a boot shaft hook mating position locking feature 472 that engages with a boot shaft hook position locking feature 452. In the exemplary embodiment, the boot shaft hook mating position locking feature 472 is provided in a form factor of a pin and the boot shaft hook position locking feature 452 is provided in a form factor of a series of apertures, holes, bores, and the like. The boot shaft hook mating position locking feature 472 is slideably inserted into the boot shaft hook position locking feature 452 retaining the calf boot shaft hook 430 in position along the elongated shaft 410. The boot shaft hook mating position locking feature 472 is slideably retracted from the boot shaft hook position locking feature 452 enabling the calf boot shaft hook 430 to slide along a length of the elongated member hook slide positioning feature 450 of the elongated shaft 410.

Actuation of the boot shaft hook mating position locking feature 472 is accomplished by the design of the locking system. The boot shaft hook mating position locking feature 472 is integrated into a position locking feature axial shaft 470. The position locking feature axial shaft 470 can be manually withdrawn by the user. An operating end of the position locking feature axial shaft 470 opposite from the boot shaft hook mating position locking feature 472 would be accessible to the user. In the exemplary embodiment, a position locking feature actuator 474 is assembled to the operating end of the position locking feature axial shaft 470. The position locking feature axial shaft 470 would pass through an aperture or hole formed through a boot shaft hook attachment end 432 of the calf boot shaft hook 430. The position locking feature actuator 474 would be located within a locking feature actuator clearance 464 formed within the boot shaft hook attachment end 432. The locking feature actuator clearance 464 could optionally include features to guide any motion of the position locking feature actuator 474. A boot shaft hook position locking feature biasing element 480 can be employed to retain the boot shaft hook mating position locking feature 472 in a normally engaged position. The boot shaft hook position locking feature biasing element 480 could be a coil spring inserted within a biasing element receiving bore 462 formed within the calf boot shaft hook 430. A biasing element support flange 476 would be integrated with the position locking feature axial shaft 470. The biasing element support flange 476 provides several functions, including support of the position locking feature axial shaft 470 within the calf boot shaft hook 430, structural support when the boot shaft hook mating position locking feature 472 and the boot shaft hook position locking feature 452 are engaged with one another, a backing element for the boot shaft hook position locking feature biasing element 480, and the like. The biasing element support flange 476 preferably is shaped having a peripheral edge that slides along an interior surface of the biasing element receiving bore 462. The peripheral shape of the biasing element support flange 476 engaging with the interior surface of the biasing element receiving bore 462 aids in supporting the position locking feature axial shaft 470 during the sliding motion as well as when positioned in the locking configuration. The boot shaft hook position locking feature biasing element 480 is preferably a compression coil spring having an uncompressed, natural length that is greater than a distance between an interior surface of the boot shaft hook position locking feature biasing element 480 and an opposing surface of the boot shaft hook position locking feature biasing element 480. This ensures generation of a compression force within the coil spring 480. The compression force from the coil spring 480 drives and retains the boot shaft hook mating position locking feature 472 within the boot shaft hook position locking feature 452. The inclusion of the series of boot shaft hook position locking features 452 enables the calf boot shaft hook 430 to be positioned based upon any boot shaft hook position locking feature 452 of the series of boot shaft hook position locking features 452.

In operation, the user would engage the position locking feature actuator 474 and draw the position locking feature axial shaft 470 outward in accordance with a locking element motion 490. The motion would compress the boot shaft hook position locking feature biasing element 480 increasing the compression force within the boot shaft hook position locking feature biasing element 480. While the shaft hook mating position locking feature 472 and the boot shaft hook position locking features 452 are disengaged, the calf boot shaft hook 430 is slideably positioned along the length of the elongated shaft 410 in accordance with a slideable positioning motion 492.

The compression force would return the position locking feature axial shaft 470 into the fixed position when the boot shaft hook mating position locking feature 472 is in alignment with one of (preferably the desired) boot shaft hook position locking feature 452 of the series of boot shaft hook position locking features 452.

The boot removal tool 500 is similar to the boot removal tool 400, wherein the pin 472 and series of apertures 452 are replaced by a toothed element 572 and a series of teeth 552 formed within a mating surface of the elongated shaft 510. Like features of the boot removal tool 500 and the boot removal tool 400 are numbered the same except preceded by a numeral "5". Operation of the boot removal tool 500 is essentially the same as the operation of the boot removal tool 400. The employment of a toothed element 572 mating with a series of formed teeth 552 enables more accurate positioning of the calf boot shaft hook 530 along a length of the elongated shaft 510. The shape and/or dimensions of the toothed element 572, the number of teeth included in the toothed element 572, and the shape and/or dimensions of each tooth of the series of formed teeth 552 would be such to ensure reliability of the boot removal tool during use. For example, the teeth can be triangularly shaped, enabling a ratcheting scenario when shortening the distance between the calf boot shaft hook 530 and the heel gripping element (120 of boot removal tool 100), while retaining engagement against an upward force applied to the boot shaft hook stop surface 538.

The above described adjustment configurations are two exemplary variants for positioning the calf boot shaft hook 430, 530 at any desired position along a length of the elongated shaft 410, 510. It is understood that any positioning system can be employed by the designer for locating the calf boot shaft hook 430, 530 at any desired position along a length of the elongated shaft 410, 510. For example, the dovetail slide configuration can be replaced by a "C" shaped channel sliding configuration, a box-shaped sliding configuration, or any other suitable sliding configuration. Similarly, the locking system can be replaced by a locking bearing system, a transversely oriented locking pin, a threaded fastener, or any other suitable fixing configuration.

It is understood that the various elements of the boot removal tool 100 can be modified to include other adaptations enabling adjustability of other elements, as previously described above.

It is understood that the ski-boot 200 can be adapted for any similar boot structure, including snow ski boots, snowboarding boots, roller blade boots, roller skate boots, and the like.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

REF. NO. DESCRIPTION

100 boot removal tool
110 elongated shaft
120 heel gripping element
122 heel gripping arm
124 heel gripping arm boot contacting surface
130 calf boot shaft hook
132 boot shaft hook attachment end
134 boot shaft hook cantilevered elongated element
136 boot shaft hook free hook end
138 boot shaft hook stop surface
140 handle
142 hand grip
144 carrying element
146 carrying element aperture
200 ski boot
210 ski boot upper
212 ski boot lower
216 boot upper rear portion
220 boot shaft
222 boot shaft pivotal calf segment
224 boot shaft pivotal segment hinge element
226 boot shaft pivotal calf segment lower segment rear portion
230 boot buckle
232 boot shaft retention strap
250 boot removal tool pivotal operating motion
299 foot removal
300 boot removal tool use flow diagram
302 obtain boot removal tool step
304 establish boot shaft hook location step (optional)
310 release boot buckle, strap and other securing devices step
312 position boot removal tool onto boot step
314 insertion boot shaft hook between boot shaft and user's calf step
316 position heel grip against boot heel step
318 draw boot removal tool rearward step
320 apply downward force to removal tool step
322 draw foot upward from ski boot step
324 remove foot from ski boot step
330 repeat for other foot steps
400 boot removal tool
410 elongated shaft
420 heel gripping element
422 heel gripping arm
424 heel gripping arm boot contacting surface
426 grip enhancing element
430 calf boot shaft hook
432 boot shaft hook attachment end
434 boot shaft hook cantilevered elongated element
436 boot shaft hook free hook end
438 boot shaft hook stop surface
440 handle
442 hand grip
450 elongated member hook slide positioning feature
452 boot shaft hook position locking feature
460 boot shaft hook axial mating slide positioning feature
462 biasing element receiving bore
464 locking feature actuator clearance
470 position locking feature axial shaft
472 boot shaft hook mating position locking feature
474 position locking feature actuator
476 biasing element support flange
480 boot shaft hook position locking feature biasing element
490 locking element motion
492 slideable positioning motion
500 boot removal tool
510 elongated shaft
530 calf boot shaft hook
532 boot shaft hook attachment end
534 boot shaft hook cantilevered elongated element
536 boot shaft hook free hook end
538 boot shaft hook stop surface
550 elongated member hook slide positioning feature
552 boot shaft hook position locking feature
560 boot shaft hook axial mating slide positioning feature

562 biasing element receiving bore
564 locking feature actuator clearance
570 position locking feature axial shaft
572 boot shaft hook mating position locking feature
574 position locking feature actuator
576 biasing element support flange
580 boot shaft hook position locking feature biasing element
590 locking element motion
592 slideable positioning motion

What is claimed is:

1. A method of extracting a foot from an athletic support boot, the method comprising steps of:

obtaining a boot removal tool, said boot removal tool comprising:

an elongated shaft extending between a heel engagement end and a handle, a heel gripping element extending generally perpendicular from said heel engagement end of said elongated shaft, and a calf boot shaft hook comprising an attachment end and a cantilevered elongated element terminating at a free hook end, wherein said calf boot shaft hook is carried by said elongated shaft at a location between said heel gripping element and said handle;

sliding a free hook end of said cantilevered elongated element into a calf segment of a boot shaft of said boot, wherein said calf region of a boot shaft is pivotally attached to a boot upper section of said boot;

abutting said heel gripping element against a rear portion of said boot on the boot shaft pivotal calf segment at a location above a boot shaft pivotal segment hinge element, wherein said boot shaft pivotal segment hinge element provides rotation between the boot shaft pivotal calf segment and a boot upper of said boot; and applying at least one of:

a rearward force to said handle, wherein said rearward force pivots said boot removal tool about a fulcrum point defined by said point of contact of said heel gripping element against said rear portion of said boot and a resulting motion of said boot removal tool causes said calf region of said boot shaft of said boot to pivot outward, and a downward force to said handle, wherein said downward force applied through said boot removal tool aids in extracting said wearer's foot from said boot by conveying said downward force from said calf boot shaft hook onto an upper edge of said calf region of said boot shaft.

2. A method of extracting a foot from an athletic support boot as recited in claim 1, the method further comprising a step of:

applying a rearward force to said handle, wherein said rearward force pivots said boot removal tool about a fulcrum point defined by said boot shaft pivotal segment hinge element and a resulting motion of said boot removal tool causes said boot shaft pivotal calf segment of said boot to pivot outward.

3. A method of extracting a foot from an athletic support boot as recited in claim 1, the method further comprising a step of:

applying a downward force to said handle, wherein said downward force applied through said boot removal tool aids in extracting said wearer's foot from said boot by conveying said downward force from said calf boot shaft hook onto an upper edge of said calf region of said boot shaft.

4. A method of extracting a foot from an athletic support boot as recited in claim 1, the method further comprising steps of:

applying a rearward force to said handle, wherein said rearward force pivots said boot removal tool about said boot shaft pivotal segment hinge element and a resulting motion of said boot removal tool causes said boot shaft pivotal calf segment of said boot to pivot outward, and subsequently applying a downward force to said handle, wherein said downward force applied through said boot removal tool aids in extracting said wearer's foot from said boot by conveying said downward force from said calf boot shaft hook onto an upper edge of said calf region of said boot shaft.

5. A method of extracting a foot from an athletic support boot as recited in claim 1, said boot removal tool further comprising a grip enhancing element applied to a contacting surface of said heel gripping element, the method further comprising a step of:

abutting said grip enhancing element on said heel gripping element against said rear portion of said boot.

6. A method of extracting a foot from an athletic support boot as recited in claim 1, said calf boot shaft hook formed to define a boot shaft hook stop surface, the method further comprising a step of:

slideably inserting said cantilevered elongated element into said calf region of said boot shaft of said boot until a top edge of said calf region of said boot shaft abuts said boot shaft hook stop surface.

7. A method of extracting a foot from an athletic support boot as recited in claim 1, wherein said step of abutting said heel gripping element against a rear portion of said boot is accomplished by abutting said heel gripping element against a lower rear portion of said boot shaft pivotal calf segment of said boot.

8. A method of extracting a foot from an athletic support boot as recited in claim 1, said boot removal tool further comprising at least one adjustable feature, wherein said at least of said following adjustable features of said boot removal tool is adjustable, enabling adaptation of said boot removal tool to a size of said boot:

a length of said elongated shaft, a position of said calf boot shaft hook, a position of said heel gripping element along a length of said elongated shaft, and a formation of said heel gripping element;

the method further comprising a step of:

adjusting said at least one adjustable feature of said boot removal tool to adapt said boot removal tool to said size of said boot.

9. A method of extracting a foot from an athletic support boot, the method comprising steps of:

obtaining a boot removal tool, said boot removal tool comprising:

an elongated shaft extending between a heel engagement end and a handle, a heel gripping element comprising a pair of heel gripping arms, each heel gripping arm extending generally perpendicular from said heel engagement end of said elongated shaft, wherein said heel gripping arms are arranged forming a generally "V" shape, and a calf boot shaft hook comprising an attachment end and a cantilevered elongated element terminating at a free hook end, wherein said calf boot shaft hook is carried by said elongated shaft at a location between said heel gripping element and said handle;

sliding a free hook end of said cantilevered elongated element into a calf segment of a boot shaft of said boot, wherein said calf region of a boot shaft is pivotally attached to a boot upper section of said boot;

abutting said heel gripping element against a rear portion of said boot on the boot shaft pivotal calf segment at a location above a boot shaft pivotal segment hinge element, wherein said boot shaft pivotal segment hinge element provides rotation between the boot shaft pivotal calf segment and a boot upper of said boot; and applying at least one of:

a rearward force to said handle, wherein said rearward force pivots said boot removal tool about a fulcrum point defined by said point of contact of said pair of heel gripping arms against said rear portion of said boot and a resulting motion of said boot removal tool causes said calf region of said boot shaft of said boot to pivot outward, and a downward force to said handle, wherein said downward force applied through said boot removal tool aids in extracting said wearer's foot from said boot by conveying said downward force from said calf boot shaft hook onto an upper edge of said calf region of said boot shaft.

10. A method of extracting a foot from an athletic support boot as recited in claim 9, the method further comprising a step of:

applying a rearward force to said handle, wherein said rearward force pivots said boot removal tool about said boot shaft pivotal segment hinge element and a resulting motion of said boot removal tool causes said boot shaft pivotal calf segment of said boot to pivot outward.

11. A method of extracting a foot from an athletic support boot as recited in claim 9, the method further comprising a step of:

applying a downward force to said handle, wherein said downward force applied through said boot removal tool aids in extracting said wearer's foot from said boot by conveying said downward force from said calf boot shaft hook onto an upper edge of said calf region of said boot shaft.

12. A method of extracting a foot from an athletic support boot as recited in claim 9, the method further comprising steps of:

applying a rearward force to said handle, wherein said rearward force pivots said boot removal tool about said boot shaft pivotal segment hinge element and a resulting motion of said boot removal tool causes said boot shaft pivotal calf segment of said boot to pivot outward, and subsequently applying a downward force to said handle, wherein said downward force applied through said boot removal tool aids in extracting said wearer's foot from said boot by conveying said downward force from said calf boot shaft hook onto an upper edge of said calf region of said boot shaft.

13. A method of extracting a foot from an athletic support boot as recited in claim 9, said boot removal tool further comprising a grip enhancing element applied to a contacting surface of each heel gripping arm said pair of heel gripping arms, the method further comprising a step of:

abutting said grip enhancing element on said heel gripping arm against said rear portion of said boot.

14. A method of extracting a foot from an athletic support boot as recited in claim 9, said calf boot shaft hook formed to define a boot shaft hook stop surface, the method further comprising a step of:

slideably inserting said cantilevered elongated element into said calf region of said boot shaft of said boot until a top edge of said calf region of said boot shaft abuts said boot shaft hook stop surface.

15. A method of extracting a foot from an athletic support boot as recited in claim 9, wherein said step of abutting said pair of heel gripping arms against a rear portion of said boot is accomplished by abutting said pair of heel gripping arms against a lower rear portion of said boot shaft pivotal calf segment of said boot.

16. A method of extracting a foot from an athletic support boot as recited in claim 9, said boot removal tool further comprising at least one adjustable feature, wherein said at least of said following adjustable features of said boot removal tool is adjustable, enabling adaptation of said boot removal tool to a size of said boot:

a length of said elongated shaft, a position of said calf boot shaft hook, a position of said heel gripping element along a length of said elongated shaft, and a formation of said heel gripping element;

the method further comprising a step of:

adjusting said at least one adjustable feature of said boot removal tool to adapt said boot removal tool to said size of said boot.

17. A method of extracting a foot from an athletic support boot, the method comprising steps of:

obtaining a boot removal tool, said boot removal tool comprising:

an elongated shaft extending between a heel engagement end and a handle, a heel gripping element extending generally perpendicular from said heel engagement end of said elongated shaft, and a calf boot shaft hook comprising an attachment end and a cantilevered elongated element terminating at a free hook end, wherein said calf boot shaft hook is carried by said elongated shaft at a location between said heel gripping element and said handle;

sliding a free hook end of said cantilevered elongated element into a calf segment of a boot shaft of said boot, wherein said calf region of a boot shaft is pivotally attached to a boot upper section of said boot;

abutting said heel gripping element against a rear portion of said boot on the boot shaft pivotal calf segment, wherein a boot shaft pivotal segment hinge element provides rotation between the boot shaft pivotal calf segment and a ski boot upper of the ski boot; and applying at least one of:

a rearward force to said handle, wherein said rearward force pivots said boot removal tool about a fulcrum point defined by said point of contact of said heel gripping element against said rear portion of said boot and a resulting motion of said boot removal tool causes said calf region of said boot shaft of said boot to pivot outward, and a downward force to said handle, wherein said downward force applied through said boot removal tool aids in extracting said wearer's foot from said boot by conveying said downward force from said calf boot shaft hook onto an upper edge of said calf region of said boot shaft.

18. A method of extracting a foot from an athletic support boot as recited in claim 17, the method further comprising a step of:

applying a rearward force to said handle, wherein said rearward force pivots said boot removal tool about a fulcrum point defined by said boot shaft pivotal segment hinge element- and a resulting motion of said boot removal tool causes said calf region of said boot shaft of said boot to pivot outward.

19. A method of extracting a foot from an athletic support boot as recited in claim 17, the method further comprising a step of:

applying a downward force to said handle, wherein said downward force applied through said boot removal tool aids in extracting said wearer's foot from said boot by conveying said downward force from said calf boot shaft hook onto an upper edge of said calf region of said boot shaft.

20. A method of extracting a foot from an athletic support boot as recited in claim 17, said boot removal tool further comprising at least one adjustable feature, wherein said at least of said following adjustable features of said boot removal tool is adjustable, enabling adaptation of said boot removal tool to a size of said boot:

a length of said elongated shaft, a position of said calf boot shaft hook, a position of said heel gripping element along a length of said elongated shaft, and a formation of said heel gripping element;

the method further comprising a step of:

adjusting said at least one adjustable feature of said boot removal tool to adapt said boot removal tool to said size of said boot.

* * * * *